US010167061B2

(12) United States Patent
Bregonzio et al.

(10) Patent No.: US 10,167,061 B2
(45) Date of Patent: Jan. 1, 2019

(54) BUOYANCY DEVICE FOR VERY DEEP WATER AND PRODUCTION METHOD THEREOF

(71) Applicant: Saipem S.p.A., San Donato Milanese (IT)

(72) Inventors: Valerio Bregonzio, San Donato Milanese (IT); Cristian Scaini, San Donato Milanese (IT)

(73) Assignee: Saipem S.p.A., San Donato Milanese (IT)

( * ) Notice: Subject to any disclaimer, the term of this patent is extended or adjusted under 35 U.S.C. 154(b) by 0 days.

(21) Appl. No.: 15/549,450

(22) PCT Filed: Feb. 9, 2016

(86) PCT No.: PCT/IB2016/050661
§ 371 (c)(1),
(2) Date: Aug. 8, 2017

(87) PCT Pub. No.: WO2016/128884
PCT Pub. Date: Aug. 18, 2016

(65) Prior Publication Data

US 2018/0022422 A1 Jan. 25, 2018

(30) Foreign Application Priority Data

Feb. 9, 2015 (IT) ..... MI2015A0176

(51) Int. Cl.
*B63B 22/04* (2006.01)
*B63B 43/14* (2006.01)
(Continued)

(52) U.S. Cl.
CPC ..... *B63B 22/04* (2013.01); *B63B 43/14* (2013.01); *C23C 18/1635* (2013.01);
(Continued)

(58) Field of Classification Search
CPC ..... B63B 22/00; B63B 22/04; B63B 22/18; B63B 43/14; B63B 22/20; B63B 43/06;
(Continued)

(56) References Cited

U.S. PATENT DOCUMENTS 3,729,756 A 5/1973 Cook et al.
4,048,686 A * 9/1977 Ege ..... B63B 22/18 441/133

(Continued)

FOREIGN PATENT DOCUMENTS

FR 2 375 024 A1 7/1978
GB 2 167 017 B 2/1988
WO WO 99/44881 A1 9/1999

*Primary Examiner* — Lars A Olson
(74) *Attorney, Agent, or Firm* — Blank Rome LLP

(57) ABSTRACT

A buoyancy device (1) comprises a support structure 2, which can be connected to an underwater application (3) and one or more buoyancy spheres (4) having a specific weight of less than 500 kg/m$^3$ connected to the support structure (2) and having a light metal spherical shell (5) defining a spherical inner volume (6) and which has an outer diameter (d) greater than 0.5 cm, and a radial thickness (t) greater than 0.08 mm, wherein the spherical shell (5) is obtained in one piece in nano-crystalline metal with an average grain size of less than 1000 nanometers.

17 Claims, 3 Drawing Sheets

Figure 1:
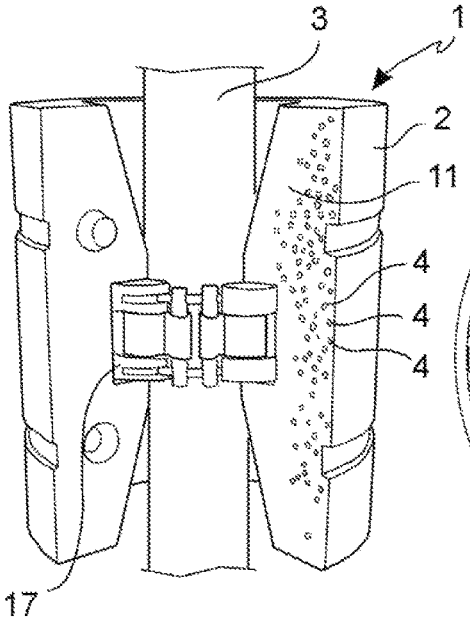

(51) Int. Cl.

| | |
|---|---|
| ***C25D 7/00*** | (2006.01) |
| ***E21B 17/01*** | (2006.01) |
| ***C23C 18/16*** | (2006.01) |
| ***C23C 18/22*** | (2006.01) |
| ***C23C 18/32*** | (2006.01) |
| ***C23C 18/38*** | (2006.01) |
| ***C25D 3/44*** | (2006.01) |
| *C25D 5/18* | (2006.01) |

(52) U.S. Cl.
CPC ..... *C23C 18/1653* (2013.01); *C23C 18/22* (2013.01); *C23C 18/32* (2013.01); *C23C 18/38* (2013.01); *C25D 3/44* (2013.01); *C25D 7/006* (2013.01); *E21B 17/012* (2013.01); *C25D 5/18* (2013.01)

(58) Field of Classification Search
CPC ..... B63B 43/08; E21B 43/00; E21B 43/013; E21B 43/0135; F16L 1/12; F16L 1/24
USPC ..... 441/29, 133; 405/168.3, 169, 171
See application file for complete search history.

(56) References Cited

U.S. PATENT DOCUMENTS

| | | | | | |
|---|---|---|---|---|---|
| 4,075,862 | A * | 2/1978 | Ames | E21B 43/013 | 405/171 |
| 4,133,182 | A * | 1/1979 | Chateau | F16L 37/002 | 405/169 |
| 4,933,917 | A * | 6/1990 | Bruneval | F16L 1/235 | 405/158 |
| 5,807,027 | A * | 9/1998 | Ostergaard | E21B 43/0135 | 405/171 |
| 7,449,074 | B2 * | 11/2008 | Branagan | B22D 11/0622 | 148/403 |
| 2010/0171312 | A1 * | 7/2010 | Burns | B63B 22/00 | 441/29 |

* cited by examiner

BUOYANCY DEVICE FOR VERY DEEP WATER AND PRODUCTION METHOD THEREOF

The present invention relates to buoyancy devices for very deep water applications and methods for producing such buoyancy devices.

Most underwater equipment (in particular equipment for offshore exploration and oil and natural gas production, e.g. risers) and all underwater vehicles require the use of buoyancy systems to impart positive buoyancy properties to the underwater equipment or vehicle.

The use of a buoyant pourable material, called syntactic foam, is known for underwater vehicles, e.g. remotely operated vehicles (ROV), and for risers which convey oil and/or natural gas from the seabed to the surface treatment plants, such as for example rigs, FPSO (floating production, storage and offloading) units, floating rigs or floating installation means etc.

Syntactic foam is a mixture of epoxy resin, polyester or other polymers with hollow glass micro-spheres having diameter of 15 μm . . . 136 μm and variable thickness of 1 μm . . . 2 μm and/or with larger size hollow glass macro-spheres, which may have diameters from a few millimeters to a few tens of millimeters. The syntactic foam may be formed into complex shapes and solidified, e.g. by means of curing, to form a solid block.

The ratio between total dry weight of the buoyant material (including all its components) and the weight of an equal volume of seawater is a parameter named "relative density". The lower the numeric value of the relative density, the higher is the buoyancy efficiency of the syntactic foam, i.e. the ratio between the net buoyancy of the buoyant material and the weight of an equal volume of seawater, where the net buoyancy corresponds to the difference between the weight of the buoyant material in water and its dry weight.

As the water depth, and consequently the hydrostatic pressure to which the buoyant material is subjected, increases, the syntactic foam must have an increasingly greater compressive strength, which can be achieved, within given limits, by increasing the ratio between wall thickness and diameter of the glass spheres. An increase of weight and a decrease of the buoyancy efficiency results.

Taking geometric imperfections, the material of the glass micro-spheres and the actual conditions of use into account, buoyant materials made of syntactic foam with sufficient compressive strength for water depth of up to 3000 meters could ideally achieve a limit buoyancy efficiency of about 0.5. The manufacturers of syntactic foam for water depths of up to 2500 m-3000 m declare relative density values of about 0.6.

In deeper water, the more efficient, lighter syntactic foams would be crushed and the use of heavier syntactic foams, which are more pressure-resistant, would imply a considerable increase of volume and costs of the buoyant material for a given buoyancy.

For example, at a depth of 6000 meters, a typical work class ROV would require a volume of syntactic foam in the order of twice the size of the buoyant volume required at a depth of 3000 meters.

The use of macro-spheres of different materials has been experimented with the two-fold objective of reducing the specific weight of the buoyant body and of increasing its hydrostatic compressive strength at the same time.

WO 99/44881 describes an example of aluminum macro-sphere having a diameter of 240 mm and a wall thickness of 4 mm, produced by forging and thermally treating two semi-spherical caps and by gluing the semi-spherical caps by means of cyanoacrylate adhesive.

Despite the excellent theoretical buoyancy efficiency given by the lightness of the material and the high theoretical ratio between outer diameter and wall thickness of the forged and glued sphere, its compressive strength is compromised, in practice, by the shape and material discontinuity at the joint line and by the shape imperfections of the forged semi-spherical caps, as well as by the unsuitability of the material properties, in particular the yield strength of aluminum. For these reasons, the metal macro-sphere suggested in WO 99/44881 has a critical load (buckling strength) and a maximum yield strength which are not always satisfactory for hydrostatic pressures in deep seawater.

U.S. Pat. No. 4,598,106 describes the use of macro-spheres made of ceramic material inserted in a syntactic foam housing, in which the cavities of the housing which receive the spheres allow the introduction of water which applies the hydrostatic pressure directly on the spheres.

The production of hollow spheres of ceramic material and the use of hollow ceramic spheres in buoyancy bodies of a remotely operated underwater vehicle (ROV) are described in scientific literature,

*Alumina ceramic* 3.6-*inch in flotation spheres for ROV/AUV systems*, S. Weston J. Stachiv R. Merewether M. Olsson G. Jemmot, 2005

*The Nereus Hybrid Underwater Robotic Vehicle for Global Ocean Science Operations to* 11,000 m *Depth,* 2007

The first of the two studies reports a sensitivity of ceramic to sustained pressure and to work cycles (cyclic fatigue life), which can cause unexpected failures at load values lower than the theoretical values.

Thus, it is the object of the invention to provide buoyancy systems for very deep water (deeper than 3000 m) which have a satisfactory buoyancy efficiency, preferably greater than 0.5, and which can better sustain the hydrostatic working pressure (p>300 bar).

It is a particular object of the invention to provide buoyancy systems with one or more hollow macro-spheres resistant to sustained cyclic and/or permanent stresses, as well as impacts.

It is a further object of the invention to provide buoyancy systems with one or more hollow macro-spheres made of light, but ductile material with a high yield strength to better sustain the maximum hydrostatic pressures.

It is a further particular object of the invention to provide buoyancy systems with one or more hollow micro-spheres made of metal material having a high geometric uniformity and material homogeneity to avoid problems of instability induced by imperfections.

These and other objects are achieved by means of a buoyancy device comprising:

- a support structure, which can be connected to an underwater application, and
- one or more buoyancy spheres connected to the support structure and having a metal spherical shell which delimits a spherical inner volume, in which each of said buoyancy spheres has:
  - an outer diameter greater than 0.5 cm,
  - a radial thickness of the spherical shell greater than 0.08 mm,
  - a density lower than 500 kg/m$^3$, characterized in that the spherical shell is obtained in one piece in nano-crystalline metal with an average grain size of less than 1000 nanometers, preferably in the range from 10 nm to 800 nm, and even more preferably in the range from 10 nm to 200 nm.

By virtue of the use of nano-crystalline metal material as structural material of the microscopic buoyancy spheres, it is possible to increase the yield strength, ductility and tenacity of the spherical shell for a given weight, thus increasing the maximum load (maximum hydrostatic pressure strength) of the buoyancy spheres for a given buoyancy efficiency.

In response to extreme stresses of the spherical shell, the nano-particle size allows a crystal growth with consequent increase of the particle size which permits the activation of more conventional deformation mechanisms, such as the multiplication and the accumulation of the intragranular dislocations, which favor strain hardening, greater tenacity and high plastic deformations.

According to an aspect of the invention, the spherical shell is obtained by means of deposition of metal nano-particles along a predetermined spherical geometry.

A two-fold technical effect is achieved by obtaining the spherical shell by deposition of metal nano-particles along a predetermined spherical geometry. The deposition of nano-particles allows a particle-by-particle construction of the spherical cap following precisely the ideal spherical geometry to sustain hydrostatic pressure and considerably reducing geometric imperfections. On the other hand, the same particle-by-particle construction allows to obtain the crystalline structure with nanometric grain size and high mechanical property homogeneity of the metal material in all the zones of the spherical shell.

This allows to obtain metal macro-spheres with high buoyancy efficiency (low relative density) which have a high maximum load value (as a function of the yield strength of the material) and a high critical load value (buckling as a function of the modulus of elasticity and of the geometric and material imperfections).

Expressed in simplified formulas which can be used for the approximate design of the hollow macro-spheres, the compressive stress limit (maximum load) and critical pressure (critical load) values are:

$$\sigma_c=(p*r)/(2*t)\leq\sigma_{lim}/\mathrm{SF}$$

$$p_{cr}=K*E*t^2/r^2$$

where:

K is an empiric reduction factor of the critical load by effect of shape imperfections (sphericity, manufacturing tolerances, joint lines etc.) and of material imperfections (lack of homogeneity, residual stress etc.)

SF is a safety factor (applied to the yield strength $\sigma_{lim}$ of the material)

r, t are the radius and thickness of the sphere

E is the Young's modulus of elasticity of the material $\sigma_{lim}$ is the yield stress of the material p is the outer pressure, these equations relate to a thin shell sphere model applicable to a condition of r/t>10.

The present invention provides buoyancy systems with metal macro-spheres, in which the $\sigma_c$ and $p_{cr}$ values are both increased for a given buoyancy, with respect to the prior art. This allows to use the buoyancy systems at depths from 4500 m to 6000 m with corresponding hydrostatic pressures from about 450 bar to 600 bar.

According to an aspect of the invention, the spherical shell constitutes a supporting layer of a multilayer spherical wall having a base layer with a deposition surface on which the spherical shell is formed by means of electrodeposition.

The base layer may be a thin, light layer with very high geometric accuracy but without particular mechanical strength, which ensures the geometric accuracy during particle-by-particle construction of the spherical shell by means of electrodeposition.

The spherical shell is preferably made of aluminum or aluminum alloy, e.g. aluminum-manganese (Al—Mn) alloy. Aluminum and its alloys are light, may be constructed in controlled manner by means of deposition of nano-particles with expectable and repeatable results with regard to the crystalline structure and the grain size, as described for example in *Electrodeposited Al—Mn alloys with microcrystalline, nanocrystalline, amorphous and nano-quasicrystalline structures*, S. Y. Ruan and C. A. Schuh, Acta Mater 57,3810(2009), *Towards electroformed nonstructured aluminium alloys with high strength and ductility*, Schuh A. C. Ruan S., MIT, 2011.

More in general, in addition to electrodeposition, suitable procedures for nano-particle deposition or for atomic or molecular deposition may include physical vapor deposition (PVD), chemical vapor deposition (CVD) and powder deposition, ensuring however a nano-particle size of the deposited powder.

Examples of electrodeposition procedures include electroplating and electrophoretic deposition.

Examples of physical vapor deposition (PVD) are thermal evaporation deposition (which exploits the Joule effect), electron beam physical vapor deposition (which vaporizes the material to be deposited by means of an electron beam), sputtering (in which the material to be deposited is eroded by plasma), arc evaporation deposition (in which the evaporation is produced by an electric discharge directed onto the material), pulsed laser deposition (with vaporization of the material by means of high-power laser). The resulting structure of the spherical shell is constructed atom-by-atom (atomic or molecular deposition).

Examples of procedures of powder deposition with nano-particle sizes are welded powder deposition, laser powder deposition, powder bed 3D printing.

According to a further aspect of the invention, the nano-crystalline metal of the spherical shell has a particle size without an amorphous phase (or with an amorphous phase lower than 3% Vol), and preferably also substantially unimodal. Such a property can be easily verified by means of electronic microscopy of specimens on the outer surface of the spherical shell.

A possible measure to avoid the formation of an amorphous phase in metal alloys, in particular aluminum alloys, constructed by means of electrodeposition is the application of pulsed current PC instead of a constant direct current DC at the anode and cathode poles in the electrolytic bath. Such processes are known and industrially used to obtain coatings with given surface properties (hardness etc.), while the present invention envisages its use for the targeted construction of the spherical shell as supporting and self-supporting structure of the underwater buoyancy device.

In particular, the electrodeposition of the spherical shell with the application of pulsed current leads to a series of structural advantages which make the aluminum alloy more ductile:

- the particle size is reduced to the nano-crystalline range without the formation of a concurrent amorphous phase,
- a nano-crystalline pattern is obtained with unimodal particle size, and
- a more homogenous structure.

Scientific confirmation and possible hypotheses on the reasons for these effects on the crystalline morphology of the material are given in scientific literature, e.g. in *Towards electroformed nonstructured aluminium alloys with high strength and ductility*, Schuh A. C. Ruan S., MIT, 2011.

In accordance with a further aspect of the invention, the support structure comprises a polymeric material or a syntactic foam as described with reference to the prior art, in which one or more macro-spheres are inserted with or without adhesion between sphere and matrix. In accordance with a yet further aspect of the invention, the support structure comprises a flexible net or a rigid frame forming individual seats and/or grouping seats configured to receive the buoyancy spheres either individually or in clusters. Such seats may be reversibly opened or accessible for replacement or maintenance operations of the buoyancy spheres.

In accordance with a further aspect of the invention, the buoyancy device comprises a plurality of such modular support structures which are reversibly connected to one another. This allows a modulation or adjustment of both the shape and the buoyancy capacity of the buoyancy device and an easier adaptation thereof to the offshore operative conditions (spaces, dimensions, weights, assembly sequences, accessibility for maintenance operations).

In accordance with a further aspect of the invention, either the buoyancy spheres themselves (either individually or in groups or clusters) or the support structures may be externally coated by means of a protective layer of material (e.g. rubber, polymer, foam) adapted to attenuate the impacts and/or dissipate and distribute impact energy deriving from environmental factors, such as for example underwater currents.

The buoyancy device is particularly suited for deep water applications. Preferably, the device can sustain a hydrostatic pressure higher than 300 bar, and more preferably either equal to or higher than 450 bar. Preferably, the buoyancy spheres can sustain a stress in the spherical shell wall of 450 MPa, and more preferably of 700 MPa.

Figure 2:
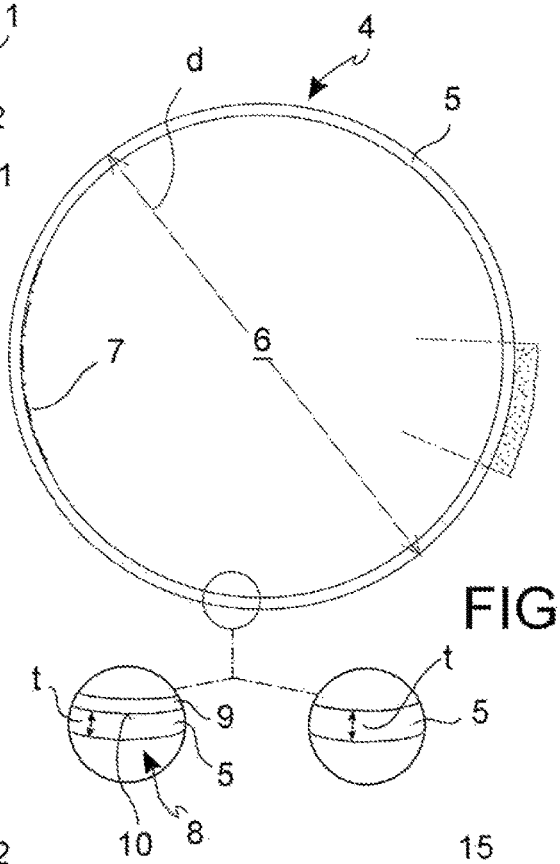
Figure 3:
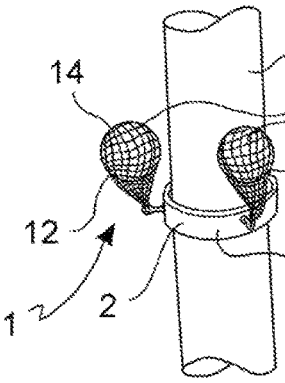
Figure 5:
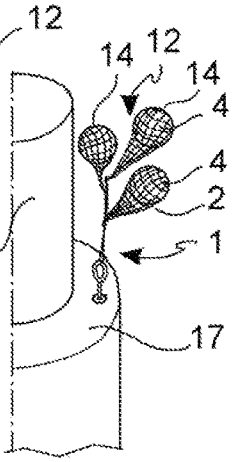
Figure 4:
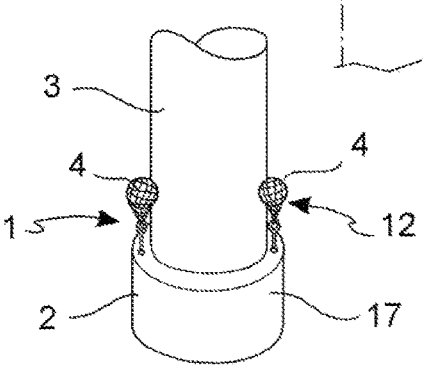
Figure 6:
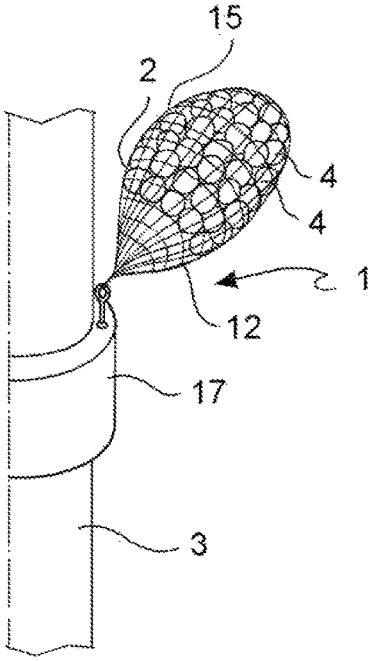
Figure 7:
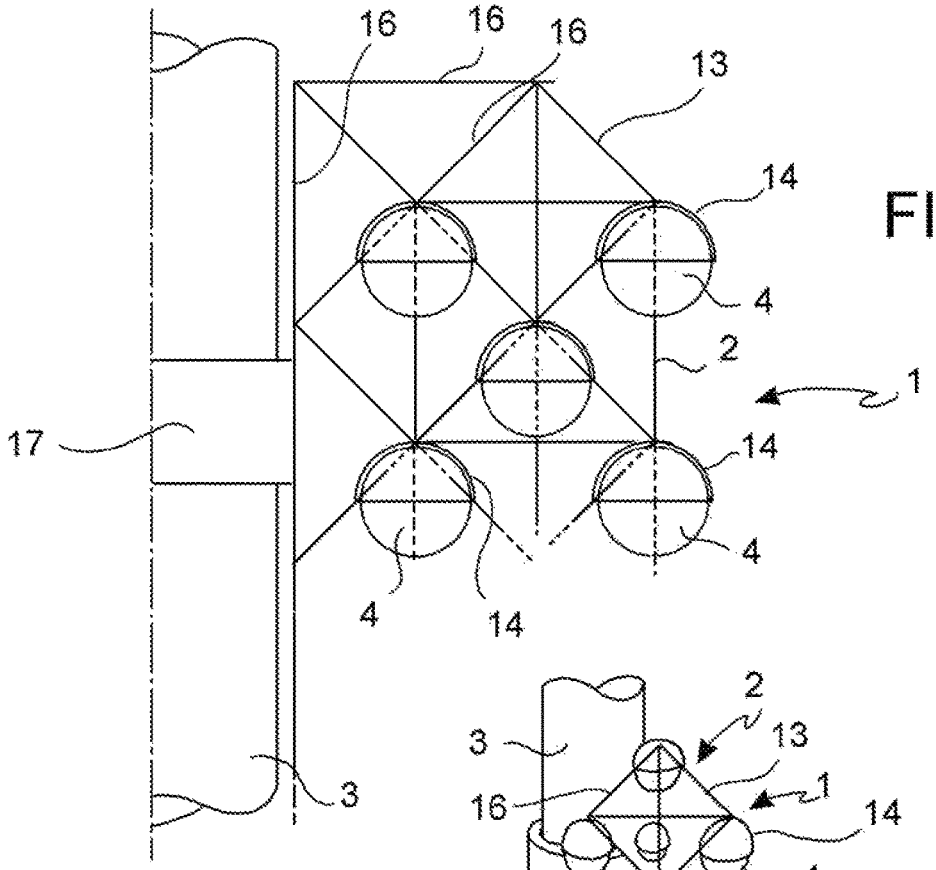
Figure 8:
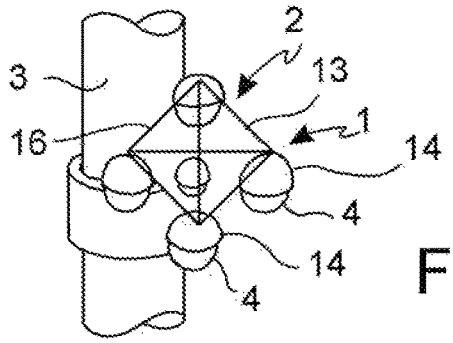
Figure 9:
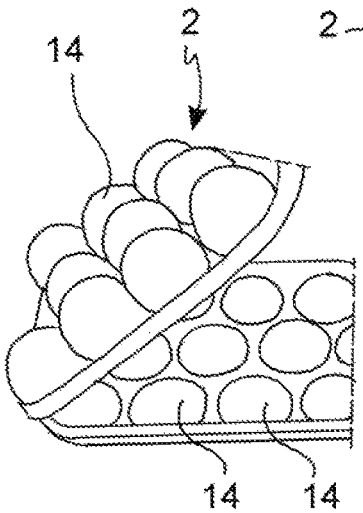
Figure 10:
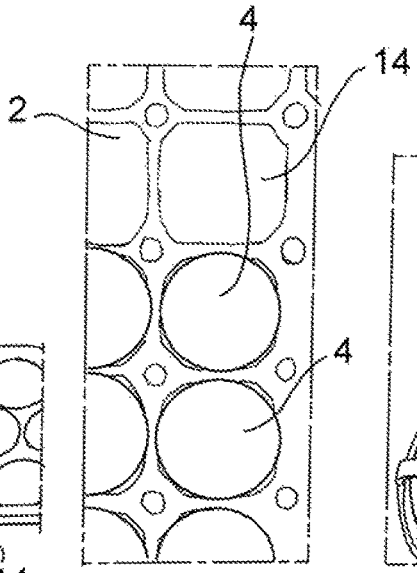
Figure 11:
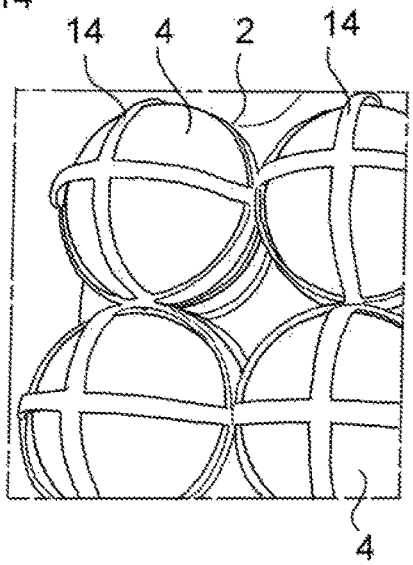
Figure 12:
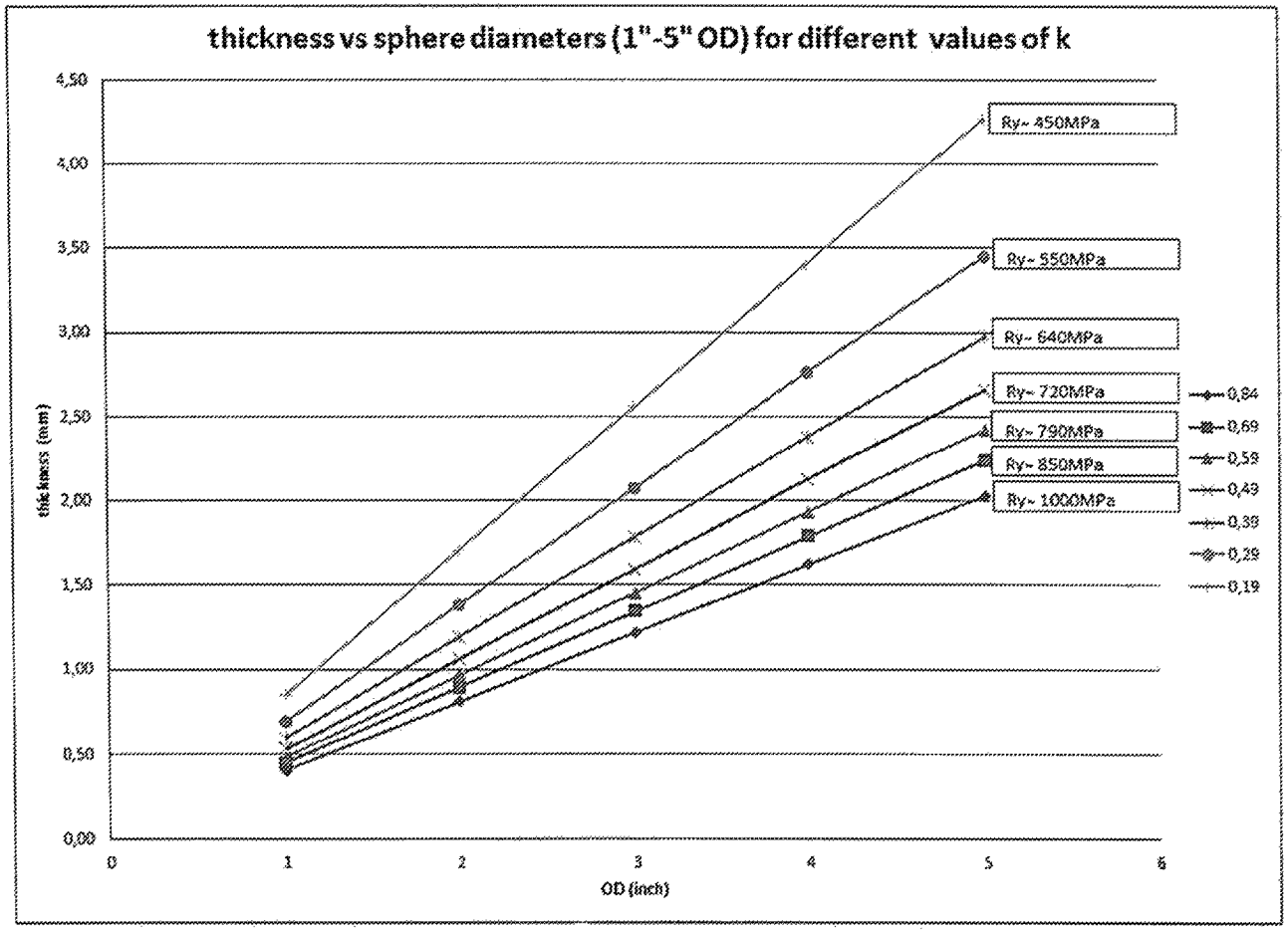

In order to better understand the invention and appreciate its advantages, some non-limitative examples of embodiments will be described below with reference to the figures, in which:

FIG. 1 shows a buoyancy device according to a possible embodiment of the invention, FIG. 2 is a section view taken along a diametric plane of a buoyancy sphere of the buoyancy device according to the invention, FIGS. 3, 4 and 5 show embodiments of the buoyancy device, in which the buoyancy spheres are individually received in a support net, FIG. 6 shows an embodiment of the buoyancy device, in which a plurality of buoyancy spheres are received and grouped in a grouping seat of a support net, FIGS. 7, 8 show embodiments of the device, in which the buoyancy spheres are individually connected to a three-dimensional and modular frame or grid, FIGS. 9, 10 show embodiments of the buoyancy device, in which the buoyancy spheres are individually received in the seats of a module having an egg-box shape of a modular support structure, FIG. 11 shows embodiments of the buoyancy device, in which the buoyancy spheres are individually received in the seats of a module having a ball-grid box shape of a modular support structure, FIG. 12 shows a chart, which indicates the ratio between thickness of the spherical shell and outer diameter (OD) of the buoyancy spheres for different levels of geometric imperfection of the spherical shell.

With reference to the figures, a buoyancy device is indicated as a whole by reference numeral 1 and comprises a support structure 2, which can be connected (e.g. by means of a fastening band 17) to an underwater application, e.g. a riser 3, one or more buoyancy spheres 4 connected to the support structure 2 and having a metal spherical shell 5, which delimits a spherical inner volume 6 (not necessarily completely void). The buoyancy spheres 4 each has an outer diameter greater than 0.5 cm, a radial thickness t of the spherical shell 5 greater than 0.08 mm, and a specific weight lower than 500 kg/m$^3$. The spherical shell is obtained in one piece (without mechanical joints and without weld seams or gluing) in nano-crystalline metal with an average grain size of less than 1000 nanometers, preferably in the range from 10 nm to 800 nm, and even more preferably in the range from 10 nm to 200 nm.

According to an embodiment, the spherical shell 5 is obtained by deposition of metal nano-particles along a predetermined spherical geometry.

The spherical geometry may be dictated by a substrate 9 of predetermined spherical shape, on which the nano-particles are deposited. In the case in which this substrate 9 defines the shape of a spherical inner surface of the spherical shell 5 to be constructed and remains therein, the spherical shell would constitute a supporting layer of a multilayer spherical wall 8 having a base layer 9 (substrate) with a deposition surface 10 on which the spherical shell 5 is formed, e.g. by means of electrodeposition.

In alternative embodiments, the spherical shell 5 may be constructed by means of the deposition of nano-particles on substrate systems or outer spherical shapes, on substrate or spherical shapes, which are either subsequently or sequentially removed from the spherical shell 5, or by means of the deposition of particles, e.g. nano-powders in the absence of a support spherical substrate (3D printing principle).

In a preferred embodiment, the spherical shell 5 is made of aluminum or aluminum alloy, e.g. aluminum-manganese alloy (Al—Mn).

In an embodiment, the nano-crystalline metal of the spherical shell 5 has a granulometry substantially without an amorphous phase, and preferably also substantially unimodal. The choice of configuring the spherical shell 5 in nano-crystalline metal without an amorphous phase reduces the onset of at least some fragility phenomena which can be related precisely to the presence of the amorphous phase in the metal.

The support structure 2 may comprise a polymeric matrix 11 (epoxy resin, polyester or other polymers) or a syntactic foam, as described with reference to the prior art, in which one or more buoyancy spheres 4 (FIG. 1) are either mixed or inserted with or without sphere-matrix adhesion or received. Alternatively or additionally, the support structure 2 may comprise one or more flexible nets 12 (FIGS. 3-6) or one or more grid-shaped rigid frames 13 (FIGS. 7, 8), which either form or connect individual seats 14 and/or grouping seats 15 to one another configured to receive the buoyancy spheres 4 either individually (FIG. 3) or in groups (FIG. 6) or in clusters (FIG. 5). For example, such seats 14, 15 may be spherical or semi-spherical caps (FIGS. 7, 8, 9), connected to one another in either fixed or modular manner by means of rods 16. Furthermore, the seats 14, 15 may be reversibly opened and accessible for replacement and maintenance operations of the buoyancy spheres 4.

According to an embodiment, the buoyancy device comprises a plurality of such support structures 2 configured as reversibly connectible modules, and preferably mutually stackable. FIGS. 9, 10, 11 show examples of construction of single modules of the support structure 2 having an egg-box and ball-grid-box shape, e.g. made of plastic, aluminum or stainless steel.

The buoyancy spheres 4 may comprise buoyancy spheres 4 of different size positioned in the support structure 2 (syntactic foam, frame, net, cage housing) so that the smaller buoyancy spheres 4 fill the interspaces between the larger buoyancy spheres 4, thus compacting the buoyancy device 1 and concentrating the buoyancy in smaller spaces. The buoyancy spheres 4 may be externally coated by a protection layer 18 of material adapted to attenuate impacts and/or to dissipate the impact energy, e.g. soft rubber, polymeric foams.

According to an embodiment, the buoyancy sphere 4 and the buoyancy device 1 are manufactured by the following steps:

providing a hollow inner sphere 9 (substrate which will form the future base layer 9 of the multilayer spherical wall 8) with an outer diameter corresponding to the inner diameter of the spherical shell 5 to be obtained. In the embodiments considered here and deemed most appropriate for underwater applications at depths greater than 3000 meters (e.g. about 4500 m-5500 m), the inner sphere 9 may have an outer diameter in the range from ⅕ of an inch to 4 inches or, for particular applications, in the range from 4 inches to 20 inches (1 inch=2.54 cm) and can be made of a chosen material (e.g. plastic) with manufacturing tolerances compatible with the final precision requirements of the buoyancy spheres 4. The inner sphere 9 does not perform any structural function in the buoyancy sphere 4 and is preferably hollow or alternatively either full or partially full, e.g. with a very low density polymeric foam.

In an embodiment, the plastic inner sphere 9 is made by means of roto-molding, by introducing polymeric powders in a revolving heated hollow mold, which melts and distributes the polymeric resin uniformly about the spherical inner wall and then cools the module to solidify and extract the inner sphere 9.

The inner sphere may be constructed by two or more parts.

Preparing a deposition surface 10 for the electrodeposition. The plastic inner sphere 9 is not electrically conductive and could require a metallization of the deposition surface on which to construct the spherical shell 5. Such a metallization may be performed, for example, by means of an electroless plating process, in which the plastic material is etched using oxidizing solutions which make the surface adapted to form hydrogen bonds ready for the subsequent deposition of metals, such as, for example, nickel or copper solution.

Alternatively, the metallization of the inner sphere 9 may be performed by means of vacuum spraying, flame spraying or arc spraying.

Metals which can be used for metallization are, for example, Ni, Cu, Zn, Al, Ag.

The step of preparing by means of metallization can be avoided by making the inner sphere 9 directly of a suitable material as substrate for the later construction of the spherical shell 5.

Electrodepositing the spherical shell 5 on the deposition surface 10 of the inner sphere 9 in ionic liquid solution, applying either pulsed current (PC) or direct current (DC), and using a 99.9% pure aluminum surface (sheet) as anode and the substrate material, e.g. 99.9% pure copper, as cathode. Other metals forming the alloy, e.g. Mn, may be provided in form of ions present in the ionic solution.

Controlling the outer sphericity of the buoyancy sphere 4, by means of optical measurement, Optionally, coating the outside of the buoyancy sphere 4 by means of an anti-shock protection layer, e.g. made of soft polymeric material.

Connecting one or more buoyancy spheres 4 to a support structure 2 to complete the buoyancy device 1.

In an embodiment of the buoyancy device 1 for 4000 m of depth, the buoyancy spheres 4 have outer diameters comprised between ⅕ of an inch and 4 inches (1 inch=2.54 cm) and thickness from 0.08 mm to 5 mm as a function of the outer diameter.

The sphericity tolerances may be referred to the critical arc model, which is known and widely disclosed in literature and will not be repeated here for the sake of conciseness, and may be in the order of up to 10% of sphericity tolerances and up to −10% of thickness tolerances (along the critical arc) in any point of the buoyancy sphere 4.

An outer working pressure is of 410 bar and requires a maximum dimensioning pressure of the buoyancy spheres 4 of 600 bar, considering an exemplary safety factor of 1.5 applied to the working pressure. In the example, the modulus of elasticity of the nano-structured metal material (Al—Mn aluminum alloy) of the spherical shell 5 is of 70 GPa. Thus, the modulus of elasticity E and also the yield stress limit $\sigma_y$ of the metal alloy of the spherical shell 5 are much higher than the yield stress values of the aluminum alloys used in the prior art for particular applications (e.g. Al 7075-T6$\sigma_y$=570 MPa, Al 7068-T6511$\sigma$=680 MPa), while the specific weight (density) of the metal alloy of the spherical shell 5 remains lower than 3000 kg/m$^3$, preferably lower than 2820 kg/m$^3$.

FIG. 12 indicates an example of the ratio between thickness of the spherical shell and outer diameter (OD) of the buoyancy spheres 4 of the buoyancy device 1 for different levels of geometric imperfection of the spherical shell 5. The boundary conditions for the actual use of the buoyancy spheres 4 shown in the chart are:

hydrostatic working pressure 400 bar;

buckling strength at an outer pressure of 600 bar;

material: Aluminum alloy.

The chart in FIG. 12 shows the enormous influence of the geometric imperfection control on the maximum achievable working load and consequently on the possibility of lightening the buoyancy spheres (by reducing the thickness t thereof) and of increasing buoyancy efficiency at very great depths.

The chart further indicates exemplary and preferred ranges, diameters and diameter/thickness ratios of the buoyancy spheres 4 according to the invention.

The buoyancy device 1 according to the invention has many advantages, in particular:

improved mechanical features, in particular with reference to strength/specific weight ratio, buckling strength, and resistance to fatigue of the buoyancy elements (considering typical stresses in the range from $10^3$ to $10^6$ cycles), shapes suited to numerous applications (risers, ROV, midwater arch etc.) both with buoyancy spheres 4 inserted in a polymeric matrix, or with buoyancy spheres 4 inserted in a liquid, semi-liquid or gelified matrix, e.g. for use with insulation systems in riser towers, or with spheres directly exposed to contact with water.

low relative density which allows to reach a seabed deeper than 3000 m, with particular advantages about 4000 m with relative density (of the single sphere) of about 0.25-0.30.

Obviously, a person skilled in art may make further changes and variants to the buoyancy device 1 and to the production method according to the present invention, all of which without departing from the scope of protection of the invention, as defined in the following claims.

The invention claimed is:

1. A buoyancy device, comprising:

a support structure which can be connected to one of an underwater installation and an underwater vehicle, one or more buoyancy spheres connected to the support structure, said buoyancy spheres having a specific weight of less than 500 kg/m$^3$, and a metal spherical shell defining a spherical inner volume and which has an outer diameter greater than 0.5 cm, and a radial thickness greater than 0.08 mm, wherein the spherical shell is obtained in one piece in nano-crystalline metal with an average grain size of less than 1000 nanometers.

2. The buoyancy device according to claim 1, wherein the spherical shell is obtained by deposition of metal nano-particles along a predetermined spherical geometry.

3. The buoyancy device according to claim 2, wherein the spherical shell is obtained by deposition of electrodeposition of aluminum or aluminum alloy.

4. The buoyancy device according to claim 1, wherein the nano-crystalline metal of the spherical shell has a particle size substantially without an amorphous phase.

5. The buoyancy device according to claim 1, wherein the outer diameter of the spherical shell ranges between 0.5 cm and 10.16 cm, and the radial thickness of the spherical shell ranges from 0.08 mm to 5 mm.

6. The buoyancy device according to claim 1, wherein the support structure comprises a polymeric matrix which houses a plurality of said buoyancy spheres.

7. The buoyancy device according to claim 1, wherein the support structure comprises at least one flexible net forming seats which receive the buoyancy spheres.

8. The buoyancy device according to claim 1, wherein the support structure comprises at least one grid-shaped rigid frame which connects seats which receive the buoyancy spheres together.

9. The buoyancy device according to claim 1, wherein the support structure comprises grouping seats, each of which receives a plurality of said buoyancy spheres.

10. The buoyancy device according to claim 8, wherein said seats form cavities with a substantially spherical curvature.

11. The buoyancy device (1) according to claim 8, wherein the seats can be reversibly opened and accessed for the replacement of the buoyancy spheres.

12. The buoyancy device according to claim 1, comprising a plurality of said support structures which are configured as modules which are reversibly connectable together.

13. The buoyancy device according to claim 12, wherein said modules are stackable and have one of an egg-box and ball-grid-box shape.

14. The buoyancy device according to claim 1, wherein the buoyancy spheres comprise smaller buoyancy spheres and larger buoyancy spheres of different dimensions than the smaller buoyancy spheres, and the smaller buoyancy spheres and the larger buoyancy spheres are positioned in the support structure so that the smaller buoyancy spheres fill interspaces between the larger buoyancy spheres.

15. The buoyancy device according to claim 1, wherein the buoyancy spheres are externally coated by a protective layer suitable to attenuate impacts.

16. A method of producing a buoyancy device, comprising:

producing one or more buoyancy spheres having a specific weight of less than 500 kg/m$^3$, and a metal spherical shell defining a spherical inner volume and which has an outer diameter greater than 0.5 cm and a radial thickness greater than 0.08 mm, connecting said one or more buoyancy spheres to a support structure for a connection to underwater installations or underwater vehicles, obtaining the spherical shell in one piece by deposition of metal nano-particles along a predetermined spherical geometry.

17. A buoyancy device, comprising:

a support structure with can be connected to one of an underwater installation and an underwater vehicle, one or more buoyancy spheres connected to the support structure, said buoyancy spheres having a specific gravity of less than 500 kg/m$^3$, and a metal spherical shell defining a spherical inner volume and which has an outer diameter greater than 0.5 cm and a radial thickness greater than 0.08 mm, wherein the spherical shell is obtained in one piece in a metal alloy having:

an elastic module E greater than 68 GPa, and a yield stress $\sigma y$ greater than 680 MPa, and a density of less than 3000 Kg/m$^3$.

* * * * *